US006848120B2

(12) United States Patent
Kling et al.

(10) Patent No.: US 6,848,120 B2
(45) Date of Patent: Feb. 1, 2005

(54) SUPPORTING STRUCTURE FOR A RESPIRATORY AIR CONTAINER OR OTHER OBJECTS

(75) Inventors: Peter Kling, Berlin (DE); Andreas Haeuser, Berlin (DE)

(73) Assignee: MSA Auer GmbH, Berlin (DE)

( * ) Notice: Subject to any disclaimer, the term of this patent is extended or adjusted under 35 U.S.C. 154(b) by 0 days.

(21) Appl. No.: 10/220,096

(22) PCT Filed: Apr. 6, 2001

(86) PCT No.: PCT/DE01/01457

§ 371 (c)(1),
(2), (4) Date: Dec. 16, 2002

(87) PCT Pub. No.: WO01/97916

PCT Pub. Date: Dec. 27, 2001

(65) Prior Publication Data

US 2003/0140392 A1 Jul. 31, 2003

(30) Foreign Application Priority Data

Jun. 19, 2000 (DE) ..... 100 29 838

(51) Int. Cl.[7] ..... A41F 9/00; A45F 3/04; B63C 11/02

(52) U.S. Cl. ..... 2/312; 2/2.15; 224/604; 224/628; 405/186

(58) Field of Search ..... 2/2.15, 94, 312; 224/637, 628, 642, 660, 148.1, 602, 148.6, 907, 604, 262; 128/205.22, 201.27; 405/186

(56) References Cited

U.S. PATENT DOCUMENTS

| | | | | | |
|---|---|---|---|---|---|
| 3,191,828 | A | * | 6/1965 | Senne | 224/604 |
| 3,355,075 | A | * | 11/1967 | Dean | 224/262 |
| 4,015,759 | A | * | 4/1977 | Dreissigacker et al. | 224/262 |
| 4,952,095 | A | * | 8/1990 | Walters | 405/186 |
| 5,823,414 | A | * | 10/1998 | Gal et al. | 224/637 |

FOREIGN PATENT DOCUMENTS

| | | | |
|---|---|---|---|
| DE | 3342202 | A1 | 7/1984 |
| DE | 297 04 328 | U1 | 7/1997 |
| EP | 0903162 | A2 | 3/1999 |

* cited by examiner

*Primary Examiner*—Rodney M. Lindsey
(74) *Attorney, Agent, or Firm*—Wood, Phillips, Katz, Clark & Mortimer

(57) ABSTRACT

The supporting plate (1) of a harness for breathing tanks and the like is flexibly connected to a waist plate (2) using an elastic formed piece (3) meant to keep said waist plate (2) on the user's back and resiliently respond to impacts, contortion, and tilting, and the link of the supporting plate and waist plate provided using the formed piece is positive-locking around a connecting pin (5*a*) in the direction of rotation of the plates against each other.

6 Claims, 2 Drawing Sheets

SUPPORTING STRUCTURE FOR A RESPIRATORY AIR CONTAINER OR OTHER OBJECTS

BACKGROUND OF THE INVENTION

1. Field of the Invention

This invention relates to a harness for breathing tanks or other objects, consisting of a supporting plate with a hinged waist plate that is supported by the users body, and fastening straps.

2. Background Art

A waist pad is known to softly support the supporting plate in the waist area. Such waist pads will attenuate any pressure applied due to the soft bolstering material used; however they may also cause shifting of the supporting plate to which at least one breathing tank or other heavy objects are attached so that an accurate and firm fit of the supporting plate to the users body is not ensured.

In addition, a harness including a waist plate hinged to the supporting plate in a joint that allows movement with multiple degrees of freedom has been proposed. This hinged joining of the waist plate and the supporting plate poses the disadvantage that it allows the former to move around 360° and may cause a user to put it on incorrectly, so that its capacity to move when worn is only restricted by the waist strap attached to it. This means that the supporting plate flexibly rests on the waist and may move to a point at which the user does no longer feel the tight and firm fit of the harness but experiences a rather insecure and shifty fit. However important wearing comfort may be, the user definitely wants to feel the harness strapped to the back in a secure and firm fit. In addition, the joint exerts a lumped unpadded load pressure on the user's body.

It is therefore an objective of this invention to design a harness of the type described above that provides excellent wearing comfort and ensures a firm fit of the supporting plate and any objects fastened thereto.

SUMMARY OF THE INVENTION

This problem is solved according to the invention by the harness comprising the characteristics described in the independent claims herein. The dependent claims disclose further characteristics and advantageous improvements of the invention.

In other words, the general concept of the invention is that an elastic formed piece is centered between the supporting plate and the waist plate, and this elastic buffer element connects the two plates in axial direction at a spacing in that these plates are positively locked to said elastic formed piece around a common center axis. Such a joint that is designed to be resilient to contortion, tilting and impacts can flexibly absorb vertical impacts between the supporting and waist plates as well as tilting or pivoting movements of the supporting plate while the waist plate stays in firm contact with the user's body. This means that the rotational and tilting movements that a supporting plate attached to the formed piece can make are elastically restricted while its firm but elastic and flexible mount ensures that the user gets the feeling of a secure fit on the back despite the flexibility of the harness.

In an improved embodiment of this invention, the elastic formed piece has such a profile that it can engage in correspondingly shaped recesses in the supporting and waist plates while the vertical connection of waist plate, formed piece and supporting plate is made using conventional fastening means such as a threaded bolt and a nut. Alternatively, profile elements protruding from the waist and supporting plates may engage in correspondingly shaped recesses in the formed piece to provide a torsionally elastic joint.

In an advantageous improvement of the invention, the formed piece has the shape of a triangular prism that partially engages in a correspondingly shaped recess in the supporting plate for flexible positive interlocking. The waist plate that sits close to the remaining base of the triangular prism is locked to the formed piece using an off-center molded pin while the vertical joint is made using a centered connecting pin.

The formed piece is preferably made of rubber. Its elasticity can be influenced by its cross section and/or recesses or cavities.

BRIEF DESCRIPTION OF THE DRAWINGS

An embodiment of the invention that illustrates other characteristics and advantages shall be explained in greater detail with reference to the figures. Wherein.

DETAILED DESCRIPTION OF THE DRAWINGS

Figure 1:
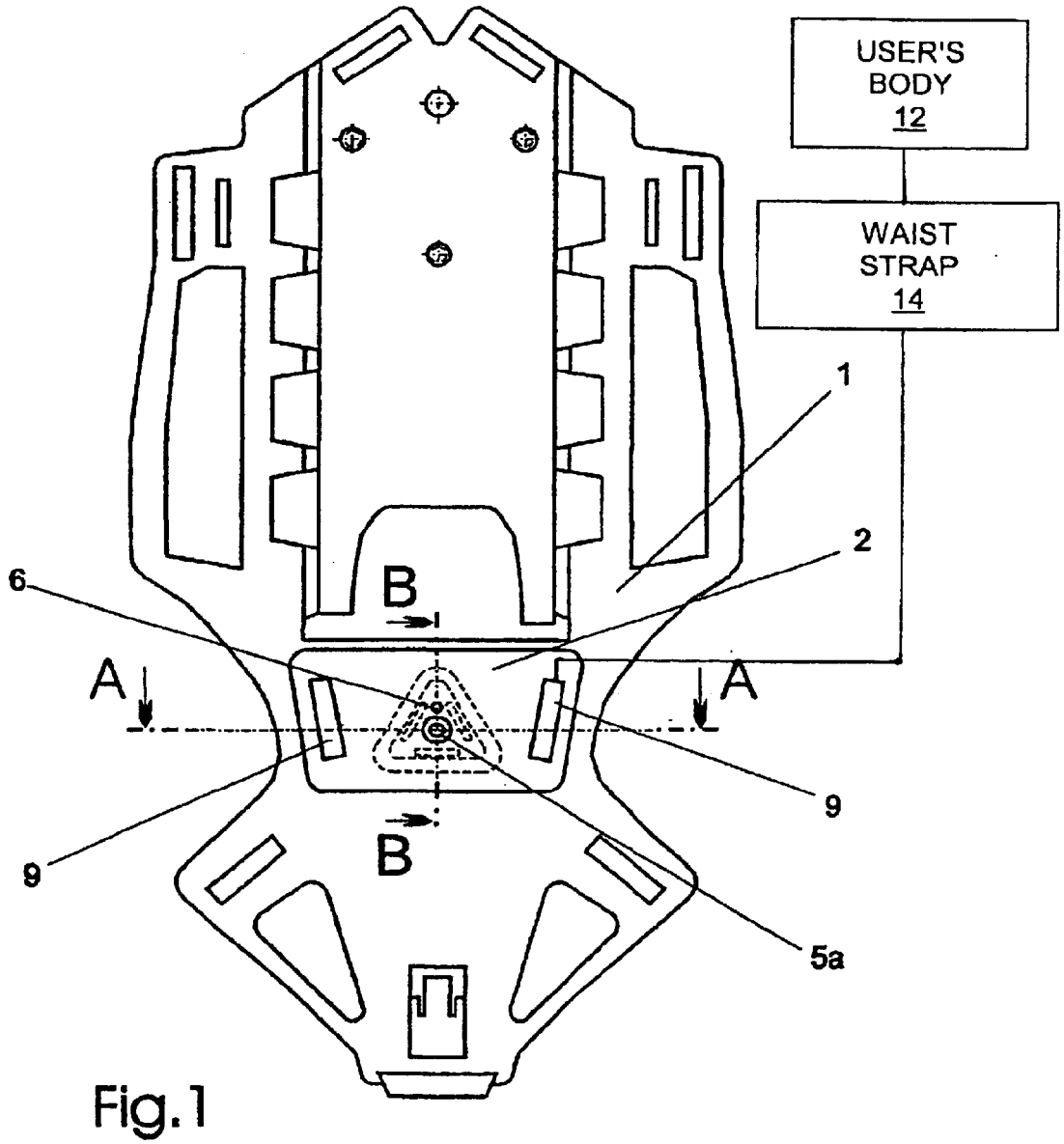
FIG. 1 shows a view of the side of a supporting plate that faces the user's back and the waist plate fastened to it according to the invention.
Figure 2:
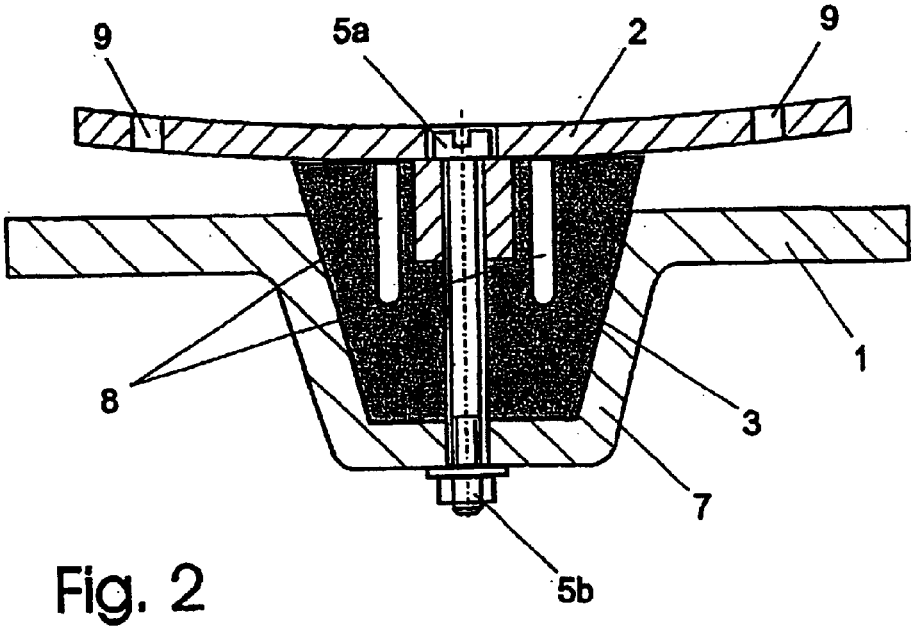
FIG. 2 shows a detailed cross-sectional view of a flexible articulated joint between the waist plate and the supporting plate along line AA in FIG. 1.
Figure 3:
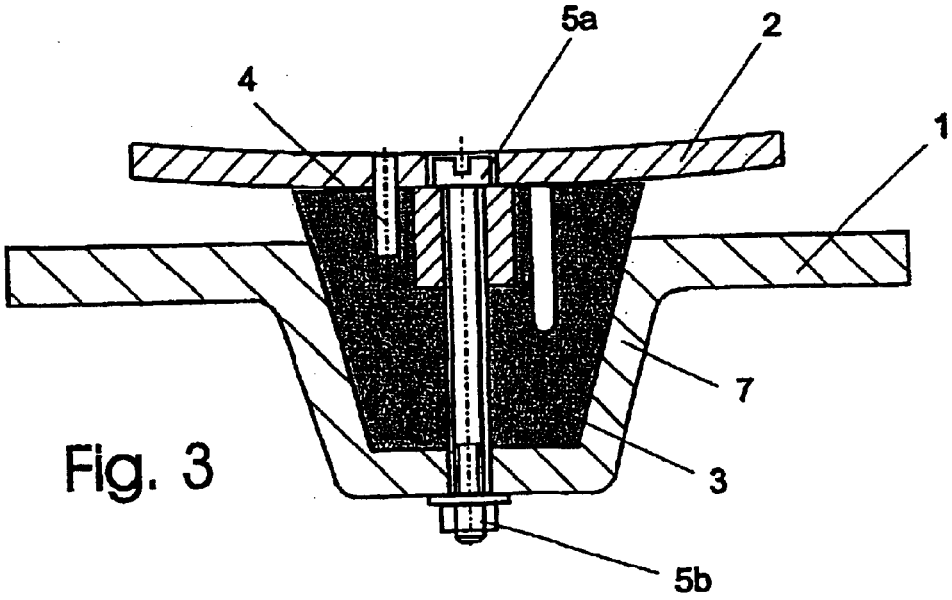
FIG. 3 shows a detailed cross-sectional view of a flexible articulated joint between the waist plate and the supporting plate along line BB in FIG. 1.

The support plate 1 shown in FIG. 1 has a waist plate 2 that rests in the small of the user's back when operational. FIG. 2 shows that said waist plate 2 is curved to match the form of the human body in this area. A formed piece 3 made of an elastic material and having a hole 6 is mounted at the bottom side of the waist plate 2 and flexibly locked to it via a protrusion/pin 4 molded to said waist plate 2. In addition, the waist plate 2 is linked to the supporting plate via the formed piece 3 using a connecting pin 5*a* of the waist plate and a nut, this joint being firm but resilient to impact and tilting. The supporting plate 1 has a seat 7 for the formed piece 3 whose triangular cross section generally matches that of the formed piece 3. However the formed piece 3 protrudes beyond the plane of the supporting plate 1 so that the waist plate 2 that sits close to the upper surface of the formed piece 3 is placed at a distance above the supporting plate 1 and can perform elastically limited tilting movements. FIG. 1 shows that the elastic formed piece 3 and its seat 7 have a generally triangular prism shape with a triangular cross section. The waist plate whose molded protrusion/pin 4 (FIG. 3) is positively locked in a recess 6 of the formed piece 3 is thus elastically and positively fixed around a rotational axis defined by the connecting pin 5*a* to allow elastic contortion. This arrangement also allows elastically limited tilting of the waist plate 2 placed at a spacing from the supporting plate 1, said tilting being determined by the elasticity of compression of the formed piece 3 which thus can absorb vertical impacts, too. The elasticity of the waist plate bearing to rotation and tilting of the supporting plate 1 is determined by its cross section, the elastic material used (such as rubber), and the dimensioning of the formed piece 3 and its seat 7. In addition, the elastic properties of the formed piece can be influenced by recesses or cavities 8 provided in it.

The waist plate 2 is firmly strapped to the user's body 12 using a waist strap 14 fastened in slotted holes 9. The supporting place with a breathing tank (not shown) attached to it is elastically hinged on the waist plate and will not directly follow the user's movement but only as much as the elasticity of the formed piece 3 allows. Thus the supporting plate 1 can be tilted and bent as limited by the elastic-formed piece 3 and is firmly held to the user's, making this plate resilient but securely fixed. This means that the user still feels the firm fit of the supporting plate to his or her back with the limited elastic and articulated support provided.

The profiled shape of the formed piece and the way it is fastened to the support plate described above is one potential embodiment. Various modifications regarding the geometry of the formed piece or its positive lock in or on the supporting and waist plates as well as its vertical fastening are conceivable within the general concept of the invention of directly joining a support and a waist plate using a formed piece made of an elastic material.

What is claimed is:

1. A harness for breathing tanks and other objects consisting of a support plate to which a waist plate supported by the user's body is flexibly hinged, and fastening straps for maintaining the support plate and waist plate on a user's body, wherein the waist plate and the supporting plate are joined for elastic contortion and tilting using a formed piece made of an elastic material, wherein joining of the supporting plate and the waist plate with the formed piece is achieved by positive lock at least in a direction of rotation, wherein the waist plate is held in a torsionally elastic positive interlock with the formed piece by an off-center protrusion engaging in an off-center hole in the formed piece, wherein the supporting plate is held in a torsionally elastic positive interlock with the formed piece through engagement of a non-circular portion on the formed piece with a correspondingly shaped seat on the supporting plate.

2. The harness according to claim 1, wherein the supporting plate, the formed piece and the waist plate are fixedly or separably linked using a connecting pin.

3. The harness according to claim 1, wherein the elastic formed piece is made of rubber.

4. The harness according to claim 1, wherein the formed piece comprises recesses or cavities to influence elastic properties for the formed piece.

5. A harness for breathing tanks and other objects consisting of a support plate to which a waist plate supported by the user's body is flexibly hinged, and fastening straps for maintaining the support plate and waist plate on a user's body, wherein the waist plate and the supporting plate are joined for elastic contortion and tilting using a formed piece made of an elastic material, wherein joining of the supporting plate and the waist plate with the formed piece is achieved by positive lock at least in a direction of rotation, wherein the formed piece has a portion with a shape of a triangular prism and the supporting plate has a seat with a cross section that generally matches the triangular prism shape of the portion of the formed piece, wherein the formed piece has a base that protrudes from the seat, wherein the base resides adjacent to the waist plate and is positively interlocked with the waist plate.

6. The harness according to claim 5, wherein the waist plate has a protrusion that engages in a recess in the elastic formed piece for torsionally elastic interlock between the formed piece and the waist plate.

* * * * *